United States Patent [19]

Dempsey

[11] 4,012,742

[45] Mar. 15, 1977

[54] MULTIMODE LOOP ANTENNA

[75] Inventor: Richard C. Dempsey, Chatsworth, Calif.

[73] Assignee: International Telephone and Telegraph Corporation, New York, N.Y.

[22] Filed: Dec. 29, 1975

[21] Appl. No.: 644,439

[52] U.S. Cl. ..... 343/742; 343/854; 343/855

[51] Int. Cl.[2] ..... H01Q 7/00

[58] Field of Search ..... 343/741, 742, 743, 744, 343/854, 855

[56] References Cited

UNITED STATES PATENTS

| | | | |
|---|---|---|---|
| 2,490,815 | 12/1949 | Kandoian | 343/743 |
| 3,613,099 | 10/1971 | Hollins | 343/742 |
| 3,725,943 | 4/1973 | Spanos | 343/854 |

*Primary Examiner*—Eli Lieberman
*Attorney, Agent, or Firm*—William T. O'Neil

[57] ABSTRACT

A multimode loop antenna arrangement for generating various radiation/reception patterns, the loop comprises a plurality of peripheral gaps which are fed through hybrid networks or the like for the production of specialized patterns, such as cardioid, mutually orthogonal dipole modes, and combination modes, such as the so-called turnstile configuration. The antenna is basically non-resonant unless separately tuned and is most useful where broadband operation and minimal size and weight are important.

5 Claims, 12 Drawing Figures

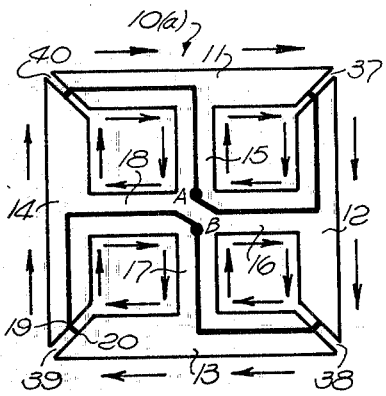
FIG. 1(a)
LOOP MODE
LOOP CURRENT
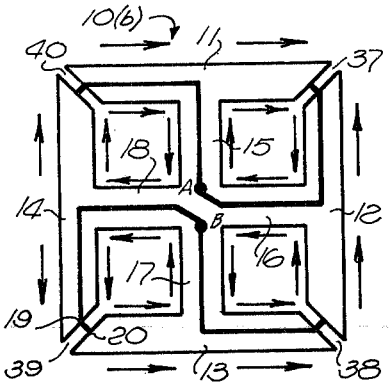
FIG. 1(b)
DIPOLE MODE
LOOP CURRENT
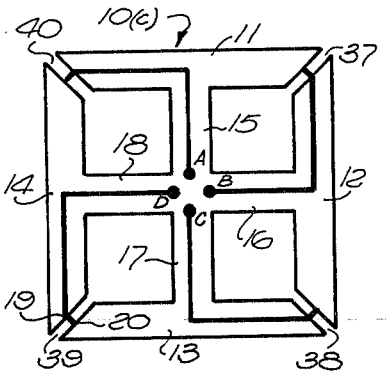
FIG. 1(c)
MULTIMODE
LOOP ANTENNA
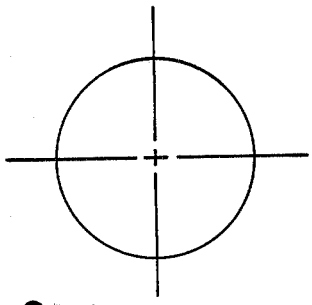
FIG. 2(a) LOOP MODE
AZIMUTH PATTERN
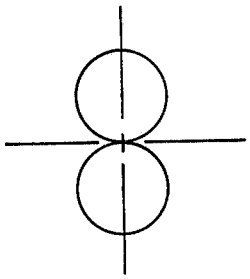
FIG. 2(b) DIPOLE MODE
AZIMUTH PATTERN
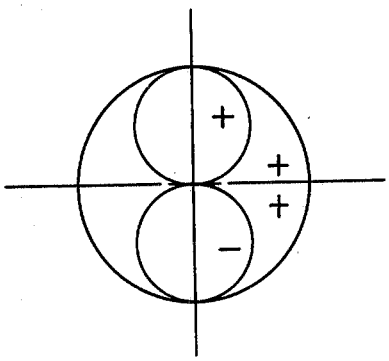
FIG. 3(a)
DIPOLE AND LOOP MODE
PHASE RELATIONSHIP
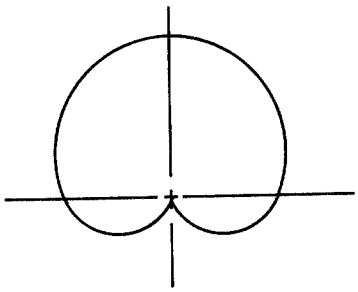
FIG. 3(b)
DIPOLE AND LOOP MODE
COMBINED FIG. 4
TURNSTILE MODE TURNSTILE PATTERN.
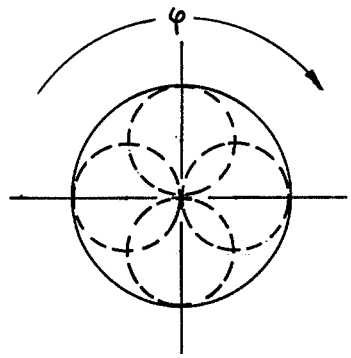
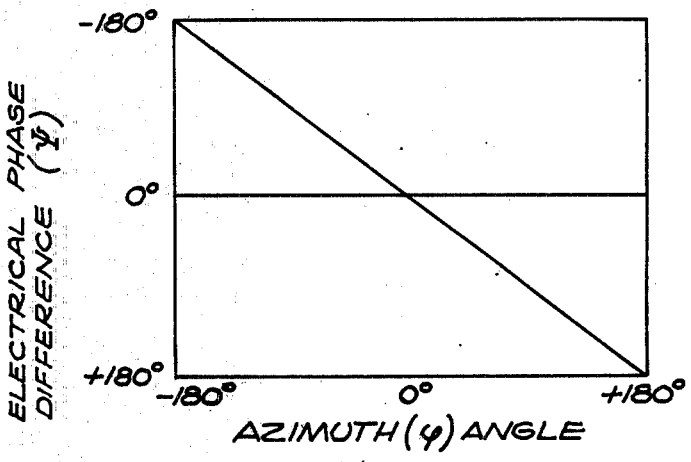
ELECTRIC PHASE DIFFERENCE Ψ AS A FUNCTION OF AZIMUTH ANGLE φ
FIG. 5 MULTIMODE LOOP ANTENNA GUIDANCE FUNCTION
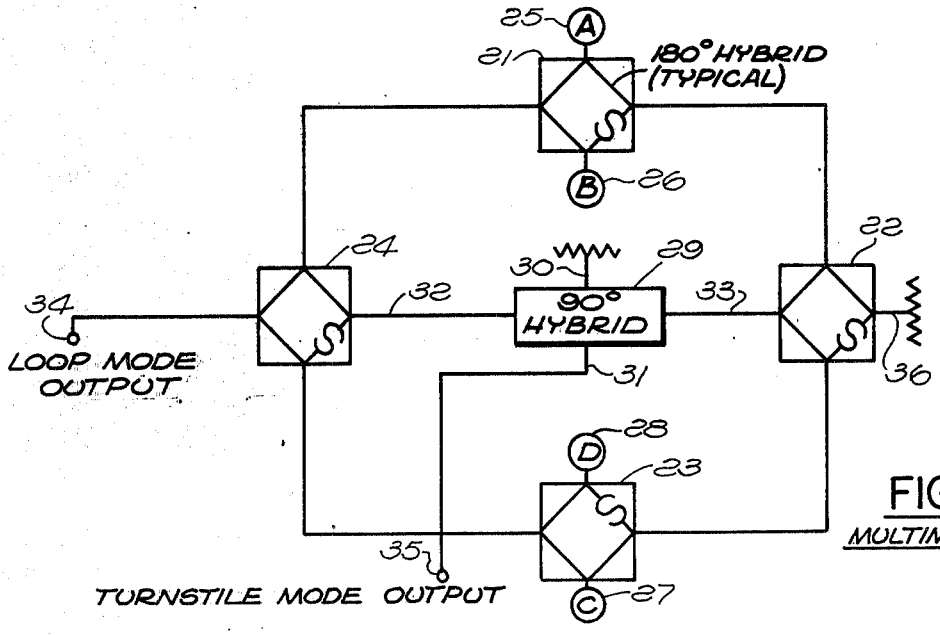
FIG. 6 DIAGRAM-MULTIMODE LOOP FEED NETWORK

MULTIMODE LOOP ANTENNA

BACKGROUND OF THE INVENTION

1. Field of the Invention

The invention relates to antenna systems for receiving and/or transmitting electromagnetic signals. More specifically, the invention relates to loop antenna systems with peripheral gaps.

2. Description of the Prior Art

In the prior art the loop antenna per se, has been a familiar device. Such antennas have been used for direction finding and for certain types of frequency surveillance, since they are inherently (at least as usually applied) non-resonant and relatively broadband in their operation.

The familiar vertically oriented (i.e., oriented with the plane of the loop in a vertical plane) is particularly well known in a number of variations, and has long been used in a form rotatable in the azimuth plane for null-seeking, direction-finding applications. In such cases, the radiation/receiving direction is in a plane normal to the plane of the loop, or, stated otherwise, normal to the vertical axis about which the loop is rotated in the azimuth coordinate.

A number of variations in the loop antenna art are known, such as the so-caled automatic direction finding (ADF) antennas used for aircraft direction finding and homing which utilize a multi-turn loop in conjunction with a separate monopole sense antenna in a system calculated to provide non-ambiguous bearing determination with respect to predetermined fixed radio wave sources.

Loop antennas have also been applied in antenna systems intended for transmission/reception along directional vectors lying in the plane of the loop. Accordingly, the plane of a loop intended for that type of operation would be horizontal.

In certain aerospace antenna systems, particularly in the VHF/UHF frequency regions, the pattern of an antenna when mounted in close proximity to the vehicle structure is severely distorted from its free space pattern due to the coupling to, and reflections from, the aerospace vehicle and its apendages. The achievement of the advantages of a loop antenna in respect to broadband operation, lightness and small size, are in such cases unfavorably counterbalanced by such interaction and reflections.

Still further, loop antenna systems employing separate dipoles or the like for ambiguity resolution in direction finding, suffer from the effects of separation of phase centers.

Certain other known devices such as multimode log-spiral antennas and multiple horn arrays can provide monopulse direction finding and guidance capability, however, those devices suffer a number of deficiencies when there is a firm requirement for minimum size and weight in an antenna system. Frequently an antenna system must be small relative to a wavelength at the lowest frequency of operation ($<0.1\ \lambda$).

In consideration of the foregoing general problems of the state of the art, there has been a clear need for an antenna system concept which permits retention of the particular advantages of the "edge-on" receiving loop antenna, without the disadvantages previously encountered in connection with such devices. The manner in which the present invention deals with the prior art situation to produce a particularly novel and useful loop-type antenna system will be understood as this description proceeds.

Loop antennas employing peripheral gaps have been known in the prior art for the purpose of making RF current distribution more uniform about the loop perimeter, however such prior art devices have not included the structure of the combination of the invention.

SUMMARY OF THE INVENTION

In consideration of the disadvantages of the prior art, it may be said to have been the general objective of the present invention to provide an improved loop antenna system capable of operation in a number of different modes for producing predetermined desired antenna patterns. The loop antenna system according to the invention provides a unique solution to the problems of the prior art in that it provides, as one mode of operation, for generation of a cardioid type pattern to aid in suppressing the coupling between the antenna and the aforementioned aerospace structure to which it is mounted. The device according to the invention is basically adapted for the generation of other broadband shaped patterns in addition to the cardioid shape for non-ambiguous radio frequency bearing determination. The combination of the invention provides an antenna having common phase centers for the various modes of operation while preserving a small size for a given wavelength of operation and broadband frequency coverage capability where the untuned gain of such an antenna is sufficient for a particular purpose. Very often high gain, per se, is not a particular requirement in the type of systems capable of employing the present invention because the transmission/reception function is essentially a one-way affair, unlike the common radar antenna situation where energy is being transmitted to a distant target and echo reflection signals are being received therefrom according to the inverse fourth power law.

In its most generic form, the present invention comprises a loop antenna with a plurality of uniformly spaced peripheral gaps and individual feeds for each of these gaps. When combined with an appropriate beam forming network (hybrid arrangement) the loop system as hereinafter described typically, may be caused to operate either in a classical loop mode, with substantially omnidirectional response in the plane containing the said loop; in a dipole mode, in a cardioid mode, or in a turnstile mode. The cardioid pattern is particularly useful in providing a wideband broadly-directive pattern having comparatively little "rear" response to minimize interaction with the structure and apendages of the aerospace vehicle on which it may be mounted.

In the so-called turnstile mode, the combined mutually orthogonal dipole patterns typical of that antenna mode, are achieved. A multi-mode hybrid feed arrangement is also shown whereby loop and turnstile modes may be contemporaneously achieved and are made available at separate ports. Since essentially the same antenna members produce these combined results, the phase centers for all modes are coexistent, a recognized advantage in this art.

This multiple gaps of the loop antenna, according to the invention, may readily be fed from coaxial or other transmission line types.

Mechanical mounting of the loop may be by means of a columnar bracket projecting preferably normally with respect to the plane of the loop from the hub or point of junction of the support spokes of the loop.

The loop itself is shown typically as formed of hollow conductive material suitable for electrical and environmental requirements, these being readily being understood by those of skill in this art.

The detailed description as to how a preferred embodiment in accordance with the principles of the present invention may be constructed and used will be evident as this description proceeds.

BRIEF DESCRIPTION OF THE DRAWINGS

FIGS. 1(a), 1(b) and 1(c) depict the feed connections for loop, dipole, and multimode feed for a loop antenna system in accordance with the present invention.

FIGS. 2(a) and 2(b) respectively, depict the azimuth patterns for a loop antenna according to FIG. 1(a) or FIG. 1(b) oriented in the horizontal plane.

FIG. 3(a) depicts relative dipole and loop mode phase relationships in a loop antenna according to the present invention, and FIG. 3(b) depicts a combined pattern produced by combining dipole and loop patterns.

FIG. 4 depicts the turnstile mode pattern for the feed arrangement in accordance with the FIG. 1(c).

FIG. 5 depicts phase vs. azimuth angle relationship in graphical form.

FIG. 6 is a schematic block diagram depicting a typical beam-forming feed network for use with the feed configuration of FIG. 1(c) for multimode operation in accordance with the invention.

DESCRIPTION OF THE PREFERRED EMBODIMENTS

Figure 7:
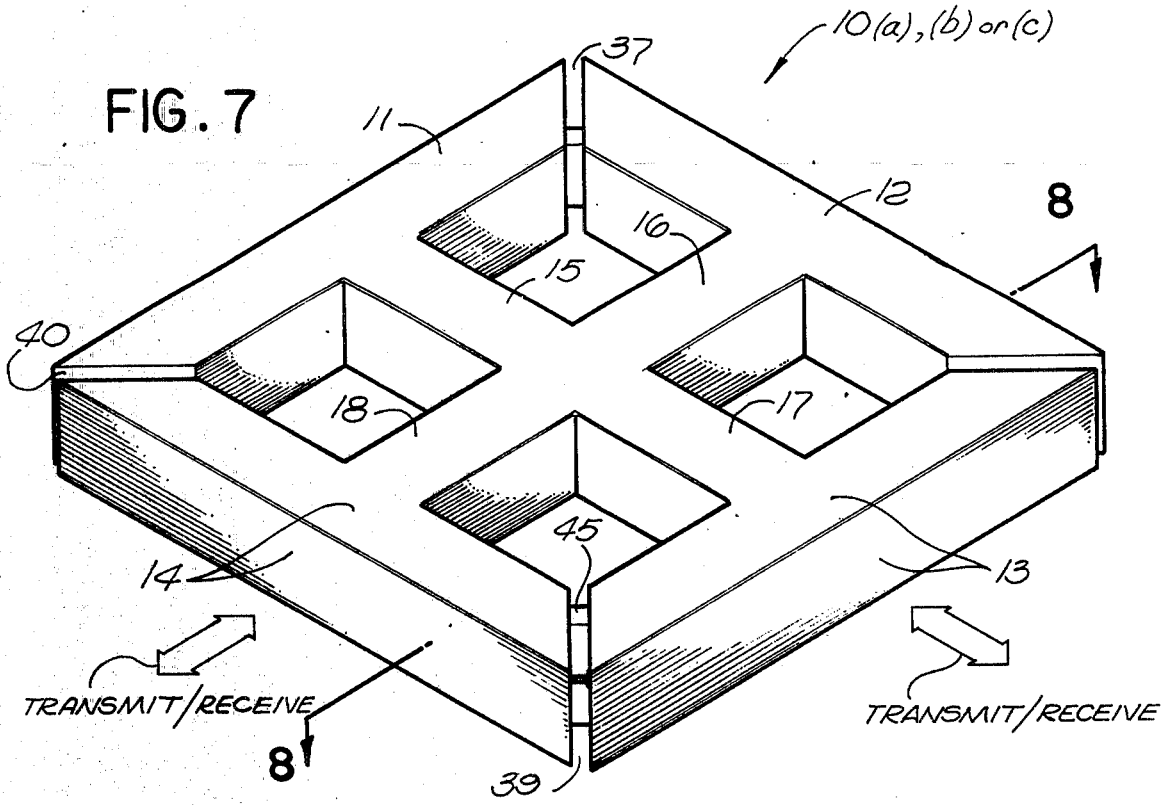
FIG. 7 is a pictorial view of a typical loop antenna according to the invention.

At the outset it is desirable to consider FIG. 7 which is an isometric type pictorial to gain a general impression of the loop antenna, per se, of the invention. Loop 10 is illustrated as an equilateral rectangle formed of hollow tubular conductive material, including the four legs 11, 12, 13 and 14. These legs of the loop are joined as shown by two mutually orthogonal spokes comprising 15 and 17 in one direction, and 16 and 18 in the other direction, as shown in FIG. 7. These spoke members provide mechanical support as well as electrical current paths forming a plurality of sub-loops, as will be described in connection with FIG. 1.

This description is based on a four-gap version of the invention, however, from a full understanding of the invention, those skilled in this art will realize the potential for variations in this regard.

At the corners of the loop of FIG. 7, gaps 37, 38, 39 and 40 are provided. A dielectric spacer is provided in each of these gaps, for example, 45 seen in gap 39.

Figure 8:
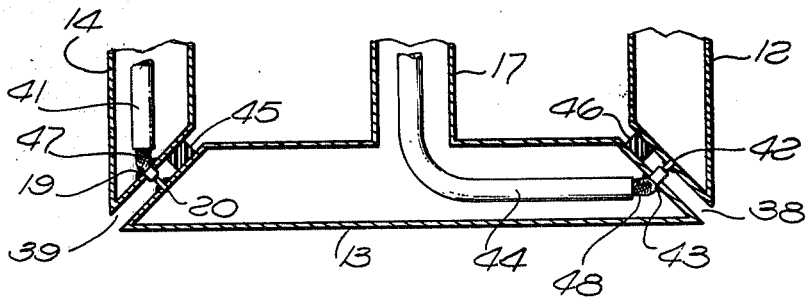
FIG. 8 is a partial sectional view taken from FIG. 7 to illustrate the gap feeds.

Referring now to FIG. 8, a partial sectional view taken through parts of the hollow tubular legs 12, 13 and 14, and a portion of the tubular spoke 17, the details of a typical physical arrangement affording an approach to the problem of feeding the gaps of the loop is illustrated. The dielectric block 45 aforementioned, is shown typically placed in the gap 39, and also an identical dielectric spacer block 46 is shown in gap 38. Coaxial feed cables 41 and 44 feed gaps 39 and and 38, respectively, in the manner illustrated. The insulating outer jacket of these coaxial cables 41 and 44 is shown cut back for a short distance at the end, exposing the outer conductors of these coaxial cables 47 and 48, respectively. Each of these outer braids or conductors of these coaxial cables is electrically bonded to the end closure plate of a corresponding hollow tubular loop leg, as illustrated at 19 and 43 bonding to 14 and 13, respectively. The center conductors of the coaxial cables 41 and 44 are insulatingly fed through the loop tubular leg end cover plate to which their respective outer conductors are bonded. Thus, in each case, the center conductor is electrically bonded to the cover plate of the loop leg on the opposite side of the corresponding gap. For example, the center conductor of coaxial cable 41 is bonded at 20 and that of cable 44 is bonded at 42. It will be realized that the same sort of situation applies to gaps 37 and 40.

A common way of mechanically mounting the loop device of FIG. 7 would be by means of a support extending normal to the plane of the loop affixed along the generally planar face thereof, at the hub of the spokes. Here the coaxial cables may be fed through externally as required.

Referring now to FIGS. 1(a), (b) and (c), the various modes of operation of a device constructed in accordance with FIGS. 7 and 8, may be described. It is assumed that all the examples of FIG. 1 represent top views of loop antennas according to the invention, lying in a horizontal plane.

In FIG. 1(a), a pair of feed terminals A and B are illustrated, terminal A connecting to feed cables in two directions to feed gaps 37 and 40. Similarly, terminal B feeds both gaps 38 and 39. The same feed arrangement applies to FIGS. 1(b), however, in FIG. 1(a), the arrows shown represent instantaneous RF currents in the loop and spoke members, as indicated, if points A and B are fed in phase. Note that in FIG. 1(a), loop currents are all in the same direction in the sub-loops and about the perimeter of the loop, this providing an omni-directional pattern of transmit/receive response in the azimuth plane, as indicated in FIG. 2(a). The loop perimeter and spokes may be thought of as providing four sub-loops.

When the loop antenna is fed, such as that points A and B have a 180° phase difference between them, then the loop perimeter currents flow as shown in FIG. 1(b) and the azimuth response pattern of the antenna is that given in FIG. 2(b), this being a dipole pattern essentially. In accordance with the foregoing, it will be obvious that the antenna structure as fed in FIG. 1(a) or FIG. 1(b) can provide alternative omnidirectional or dipole patterns merely by appropriately arranging the relative phases of the point A and B feeds. The loop mode exhibits a constant amplitude and phase pattern in the plane of the loop(horizontal plane as described) and the dipole mode exhibits a "Figure eight" amplitude pattern, FIG. 2(b), and bi-phase response pattern.

In FIG. 3(a) the dipole and loop patterns with the aforementioned phase relationships marked thereon, as shown superimposed. Since the phase responses of the loop and dipole mode to an impinging electromagnetic wave are 90° relative to each other, the two output modes may simply be combined in quadrature through the use of a 90° hybrid to provide a cardioid response as illustrated in FIG. 3(b). This particular pattern is especially useful in minimizing the coupling to the structure of a vehicle on which the loop is mounted if the cardioid "backside" faces the interferring or reflecting vehicle surfaces. This particular aspect of the invention addresses the problem hereinbefore cited in connection with loop antennas on aerospace vehicles or the like.

Looking ahead to FIG. 6, the element 29, which is a 90° hybrid, will be seen to be a suitable device if lifted from FIG. 6, for producing the cardioid pattern beam forming network. The terminals 32 and 33 of that hybrid would be connected, one each to a corresponding one of the terminals A and B of the device, as depicted in FIG. 1(a) or FIG. 1(b). The terminated hybrid terminal 30 would still be terminated as shown, and terminal 31 thereof would provide the cardioid mode feed terminal.

Such an arrangement would not only provide a large measure of decoupling of the antenna from surrounding structure on which it may be mounted, but would also provide an effective broadband cardioid pattern for use in direction finding systems.

Referring now to FIG. 1(c), it will be noted that all four gap feed lines for indicated as being available for independent feed, these being lettered A, B, C and D. This configuration provides maximum flexibility in that it can readily be connected to provide the functions described in connection with FIGS. 1(a) and FIG. 1(b), and in addition, permits the generation of other modes in accordance with the amplitude and phase of the feeds provided thereto. Note that, unlike the connections of FIG. 1(b), if the gaps 37 and 38 were fed in parallel and the gaps 39 and 40 were fed in parallel, but 180° out of phase with gap 37 and 38 feeds, the result would be the rotation of the dipole mode azimuth pattern of FIG. 2(b) by 90°. To accomplish this, the same hybrid 29 might have its terminal 32 connected to terminals A and B of FIG. 1(c), whereas terminals B and C thereof, might be connected to hybrid terminal 33. In that event, the hybrid terminal 31 would provide the aforementioned rotated dipole pattern, i.e., FIG. 2(b) rotated 90°.

Combining the two dipole modes, i.e., that of FIG. 2(b) and the 90° rotated version thereof in phase quadrature would produce a turnstile mode, as depicted in FIG. 4. The response of the turnstile mode will be seen to be essentially omnidirectional in the plane of the loop. While the amplitude responses of the loop and turnstile configurations or modes have amplitude responses which are the same in the plane of the loop, the phase response is not. The electrical phase response of the loop remains constant in respect to angular rotation about its (vertical) axis, and the electrical phase response to the turnstile mode varies directly with the loop's rotation about its axis. That is, for at 360° mechanical rotation of the loop, the electrical phase shifts uniformally over 360°. A measurement therefore of the differential phase between outputs of the loop and turnstile modes provides a measure of the direction of arrival of an impinging electromagnetic wave relative to any arbitrarily selected reference direction. This is graphically illustrated in FIG. 5, and forms the basis for the direction finding or homing utility of the arrangement.

Whenever it is desirable to provide a simultaneous response to signals whose polarizations are orthogonal to that of a given loop, a second loop may be placed in a plane orthogonal to the first loop physically. Such a double loop arrangement provides a means of proportionally determining the direction of arrival of signals in two planes in addition to affording the capability for receiving signals having any polarization configuration, thus providing a three-dimensional bearing determination for arriving signals.

Referring now to FIG. 6, a typical feed network (bridge arrangement) for generating contemporaneous loop mode output and turnstile mode output is depicted. The components illustrated are those well known to persons of skill in this art. The terminals 25, 26, 27 and 28 on FIG. 6 are those of A, B, C, and D, of FIG. 1(c). A pair of 180° hybrids 21 and 23 connected to these antenna terminals, as shown, and interconnecting with two more 180° hybrids, 22 and 24 and thence, via leads 32 and 33 to a 90° hybrid, provides loop mode and turnstile mode output terminals 34 and 35, respectively. The terminals 30 and 31 of hybrid 29 are terminated anf fed through to 35 (the turnstile port of the network), respectively. The remaining terminal of 180° hybrid 24 provides a loop mode output terminal 34, whereas the remaining output terminal of hybrid 22 is terminated at lead 36. By means of this configuration, antenna outputs characteristic of loop and turnstile modes are separately available and contemporaneously provided. These modes are provided as if generated by separate antennas, one a straightforward loop and the other a turnstile antenna, however, in the arrangement of FIG. 6, the two modes are provided with respect to a common phase center.

From an understanding of the principles of the present invention, those skilled in this art will realize that the invention is not limited to the four gap arrangement, it being possible to provide more driven gaps about the periphery of a loop antenna and achieve a capability for other modes of operation. Still further, neither the equilateral rectangular shape of the loop nor the square cross-sectional shape of the loop legs and spoke members are necessary for the implementation of the present invention. Tubing of circular or other cross-section could be employed with very similar results, and, for that matter, the perimeter shape of the antenna loop can be circular.

Alternative transmission lines can be used in lieu of the coaxial lines illustrated and described, and the entire device could, in fact, be instrumented in microstrip, with printed loop and spokes on a dielectric carrier sheet with the feed connections printed onto the opposite side of the carrier sheet. Other arrangements are also possible as will be realized by those skilled in this art.

The loop and spoke cross-sectional size influences bandwidth in a well understood manner. Overall loop antenna size vs. the lowest frequency of anticipated operation follows known criteria.

The possibility will also suggest itself to those skilled in this art for the provision of a feed network accommodating a monopulse antenna mode or various types of lobe switching configurations.

Other modifications and variations will suggest themselves to those skilled in this art, and accordingly, it is not intended that the drawings or this description should be considered as limiting the scope of the present invention, these being illustrative only.

What is claimed is:

1. A multi-mode loop antenna system including a conductive loop for radiation and reception in the plane of the loop, comprising:

a plurality of gaps uniformly spaced about the perimeter of said loop;

a plurality of spokes equal in number to said gaps radiating from a symmetrically located central area within said loop, said spokes each being conductively joined to said conductive loop at a location midway between an adjacent pair of said gaps, thereby to form a plurality of sub-loops within said loop perimeter;

and feed network means for separately feeding each of said gaps, and for combining said feeds in predetermined phase relationships, said network having at least one port and corresponding mode of operation providing a directional radiation and reception pattern in said plane, said feed phase relationships producing a corresponding direction of instantaneous current flow in each of said sub-loops.

2. Apparatus according to claim 1 in which said feed network means includes at least two ports and interconnecting hybrid network means for combining said gap feeds in a manner producing a contemporaneous mode of operation with a corresponding radiation and reception pattern based on a common phase center, for each of said ports.

3. Apparatus according to claim 1 further including an external port and a combining network for exciting said gap feeds in a manner producing a pattern which is the algebraic sum of at least two of said modes of operation.

4. Apparatus according to claim 3 in which said feed network means comprises a first parallel connection of the gap feeds to a predetermined adjacent pair of said gaps and a second parallel connection of the gap feeds of the opposite adjacent pair of said gaps thereby producing a pair of terminals, and a hybrid network for feeding said pair of terminals in 180° phase relationship, said network providing a single external port for providing a combined feed to said gaps to produce a combined dipole and loop mode pattern which is substantially cardioid shaped.

5. Apparatus according to claim 1 in which said feed network means comprises four 180°, four port hybrids and a 90°, four port hybrid, said 180° hybrids being arranged in a bridge circuit, a first opposite 180° hybrid pair of said bridge connecting, one each, to the gaps of an adjacent pair of said gaps and an opposite adjacent gap pair, one of the remaining ports of a selected one of a second opposite 180° hybrid pair providing a port corresponding to the loop mode of operation, said 90° hybrid having two opposite ports connected between a remaining port of said selected 180° hybrid and a port of the other 180° hybrid of said second pair of 180° hybrids, one of the remaining ports of said 90° hybrid providing a turnstile mode output.

* * * * *

UNITED STATES PATENT OFFICE
CERTIFICATE OF CORRECTION

PATENT NO. : 4,012,742
DATED : March 15, 1977
INVENTOR(S) : Richard Clyde Dempsey It is certified that error appears in the above-identified patent and that said Letters Patent are hereby corrected as shown below:

Column 1, between lines 9 and 10, add the paragraph:

-- The Government of the United States has rights in this invention pursuant to Government Contract No. F-33657-72-C-0182.--

Signed and Sealed this

*Eighth* Day of *November 1977*

[SEAL]

*Attest:*

RUTH C. MASON
*Attesting Officer*

LUTRELLE F. PARKER
*Acting Commissioner of Patents and Trademarks*